US005116475A

United States Patent [19]

Edlund et al.

[11] Patent Number: 5,116,475

[45] Date of Patent: May 26, 1992

[54] METHOD FOR DISCHARGING A DIGESTER

[75] Inventors: Runo E. G. Edlund, Sundsvall; Bertil K. Ernerfeldt, Njurunda, both of Sweden

[73] Assignee: Sunds Defibrator Industries Aktiebolag, Sweden

[21] Appl. No.: 588,655

[22] Filed: Sep. 26, 1990

[30] Foreign Application Priority Data

Oct. 17, 1989 [SE] Sweden ..... 8903417

[51] Int. Cl.[5] ..... D21C 7/08

[52] U.S. Cl. ..... 162/52; 162/246

[58] Field of Search ..... 162/52, 46, 47, 246

[56] References Cited

U.S. PATENT DOCUMENTS

| | | | |
|---|---|---|---|
| 1,977,379 | 10/1964 | Dunbar | 162/47 |
| 3,486,516 | 12/1969 | Stoertz | 162/52 |
| 4,105,494 | 8/1978 | Pettersson | 162/52 |
| 4,814,042 | 3/1989 | MacLeod | 162/52 |

FOREIGN PATENT DOCUMENTS

| | | | |
|---|---|---|---|
| 0100293 | 2/1984 | European Pat. Off. | 162/52 |

*Primary Examiner*—Steve Alvo

*Attorney, Agent, or Firm*—Lerner, David, Littenberg, Krumholz & Mentlik

[57] ABSTRACT

A method for discharging cooked lignocellulose materials from a digester is disclosed. After batch cooking the lignocellulose material in the digester is cooled to a temperature of about 100° C., preferably from 100° to 120° C., a gas is supplied to the upper portion of the digester to provide a gas pressure such that the combination of that gas pressure and the static pressure in the digester created by the height of cooked lignocellulose material therein exceeds by no greater than about 200 kPa the sum of the pressure required to overcome the level difference between the exit port at the bottom of the digester and an entrance port in the upper portion of a receiving vessel and the flow resistance required to transfer the cooked lignocellulose material therethrough.

6 Claims, 2 Drawing Sheets

METHOD FOR DISCHARGING A DIGESTER

FIELD OF THE INVENTION

The present invention relates to methods for discharging lignocellulose materials from digesters. More particularly, the present invention relates to methods for discharging cooked lignocellulose material from digesters after batch cooking therein.

BACKGROUND OF THE INVENTION

In connection with sulfate, sulfite and other cooking processes, the delignification of lignocellulose material, such as wood chips, is carried out. Thus, the lignocellulose material is cooked in a cooking liquor under predetermined conditions of time, temperature, pressure, the supply of chemicals, and the like. When the cooking has been concluded, conditions of high pressure and temperature prevail in the digester.

Discharge of the digester can be performed by opening a valve at the bottom of the digester so that the contents of the digester are blown out by means of the pressure prevailing within the digester through a conduit into a receiving vessel which is maintained at atmospheric pressure. Alternatively, the contents of the digester can be cooled by displacing the hot spent cooking liquor within the digester with cooler waste liquor.

In these processes, the contents of the digester are then blown out by means of high pressure air or steam into the receiving vessel. These processes are known as the "cold blow" processes. They are exemplified, for example, by Canadian Patent No. 1,135,101, corresponding to Swedish Patent No. 435,075; and by European Patent No. 100,293. In the Canadian '101 patent a system is provided for blowing the pulp from the digester at relatively low temperatures, preferably in the range of from 90° to 105° C., and in which the pulp may be prewashed within the digester. In particular, as is shown in connection with the discussion of FIG. 3 therein, at the final stage of digesting, the cooking liquor is fed to an equalizing tank maintained under pressure. The pressure in the digester 1 is then lowered to substantially atmospheric pressure by opening a steam valve, and washing liquor is fed to the digester during this period through valve 15 as shown in FIG. 3. In this manner, the contents of the digester are blown at the above-mentioned temperatures to provide such a cold blow process.

As for the European '293 patent, a further such cold blow process is shown with respect to FIG. 1 thereof in which the spent cooking liquor is discharged from the digester by using a curtain of compressed, relatively cool air at the top of the digester to force the pulp out through a blow valve into a blow tank. In accordance with this process, washer filtrate liquor from tank 17 is used as the displacement liquid during operation of the digester. It is at this point that the relatively cool air is injected into the top of the digester, i.e., after displacement, preferably at a pressure of about 0.5 to 1.0 MPa.

In both of these above cold blow processes, flushing or displacement is required therewith. Also, high pressure is required in order to achieve blowing from the digester in order to guarantee complete discharge of the material therein. However, at the same time, discharge is difficult to control since the consistency of the material will vary considerably. Furthermore, steam or air can penetrate the material through channels prior to emptying of the digester.

Additional problems in these prior art systems concern control of possible blow condensers. Thus, problems with potential pressure shocks to gas treatment and with transfer to condensate can arise. In order to deal with these problems, the gas treatment equipment has thus been extensive and quite costly.

One method of obtaining a more controlled discharge is to relieve the overpressure in the digester, and to reduce the temperature to below about 100° C. The material can then be pumped out of the digester by means of a pump. In this manner, the need for gas treatment equipment can also be reduced or avoided. This method is known for use with batch digesters for sulfite, sulfate and other types of cooking.

However, the use of pump discharge has a number of concomitant disadvantages. A pump is very sensitive to the pressure of coarse particles. These raw materials, however, are normally accompanied by different metal objects, stone and concrete clods, as well as large pieces of wood. Even if very large pump wheels are thus used, there remains a considerable risk of sticking and clashing taking place, with resultant disturbances in production. Furthermore, pump discharge can also result in increased servicing costs and decreased reliability in operation compared with the conventional blow discharge mentioned above. In order to reconstruct old digesters, problems of sufficient space for pumps and associated conduits can arise, and thus the installation can be unreasonably high.

Another method of discharging a digester is to install a rotating discharge device. In this manner, the total digester pressure is used as the discharge force. Uniform discharge is obtained in this case by dilution of the material in a dilution zone, with simultaneous stirring by means of the discharge device itself. Such an arrangement is possible in connection with a continuous digester having a bulging bottom and employing continuous discharge. However, with a batch digester, which is normally provided with a conical bottom, such a discharge device is not suitable. Moreover, the installation and servicing of such devices in batch digesters would require considerable costs, particularly with respect to the large number of such digesters in a plant.

SUMMARY OF THE INVENTION

In accordance with the present invention, these and other difficulties have been overcome by the invention of a method for the discharge of cooked lignocellulose material from a digester containing such cooked lignocellulose material in an amount providing a predetermined static pressure to a receiving vessel in which the digester has an upper portion and a lower portion, and includes an exit port at the lower portion at a predetermined level therein, and the receiving vessel has an entrance port at a predetermined level therein, the predetermined level in the receiving vessel being higher than the predetermined level in the digester by a predetermined level difference, and the exit port of the digester and the entrance port of the receiving vessel being connectable through a conduit providing a predetermined flow resistance between the digester and the receiving vessel.

The method comprises cooling the cooked lignocellulose material in the digester to a temperature of about 100° C., supplying a gas to the upper portion of the digester so as to provide a predetermined gas pressure therein, whereby the combination of the predetermined gas pressure and the predetermined static pressure exceeds the sum of the pressure required to overcome the predetermined level difference and the predetermined flow resistance in order to transfer the cooked lignocellulose material from the digester to the receiving vessel by no greater than about 200 kPa, and connecting the exit port in the digester with the entrance port in the receiving vessel so as to transfer the cooked lignocellulose material through the conduit.

In accordance with this invention, the above-mentioned problems are thus solved in connection with discharge from a batch digester. According to this invention, a method for the control of discharge of a digester at low pressure is obtained without the use of mechanical discharge means. Specifically, no pump is required and the disadvantages associated therewith are thus eliminated, while at the same time the need for gas treatment equipment is avoided or at least minimized.

In accordance with one embodiment of the method of the present invention, dilution liquid is supplied to the lower portion of the digester.

In accordance with another embodiment of the method of the present invention, the temperature of about 100° C. is a temperature of between about 100° and 120° C.

In accordance with another embodiment of the method of the present invention, supply of the gas to the upper portion of the digester comprises increasing the supply of gas during the transfer of the lignocellulose material from the digester to the receiving vessel so as to maintain the combination of the predetermined gas pressure and the predetermined static pressure during transfer at a substantially constant level as the static pressure is reduced in the digester.

According to another embodiment of the method of the present invention, the combination of the predetermined gas pressure and the predetermined static pressure exceeds the sum of the pressure required to overcome the predetermined level difference and the predetermined flow resistance by no greater than bout 100 kPa.

In the preferred embodiment, the lignocellulose material exits the digester at a consistency of between about 3 and 10%, and preferably between about 5 and 10%.

BRIEF DESCRIPTION OF THE DRAWINGS

The present invention may be further understood with reference to the following detailed description, which refers to the following drawings.

DETAILED DESCRIPTION

Figure 1:
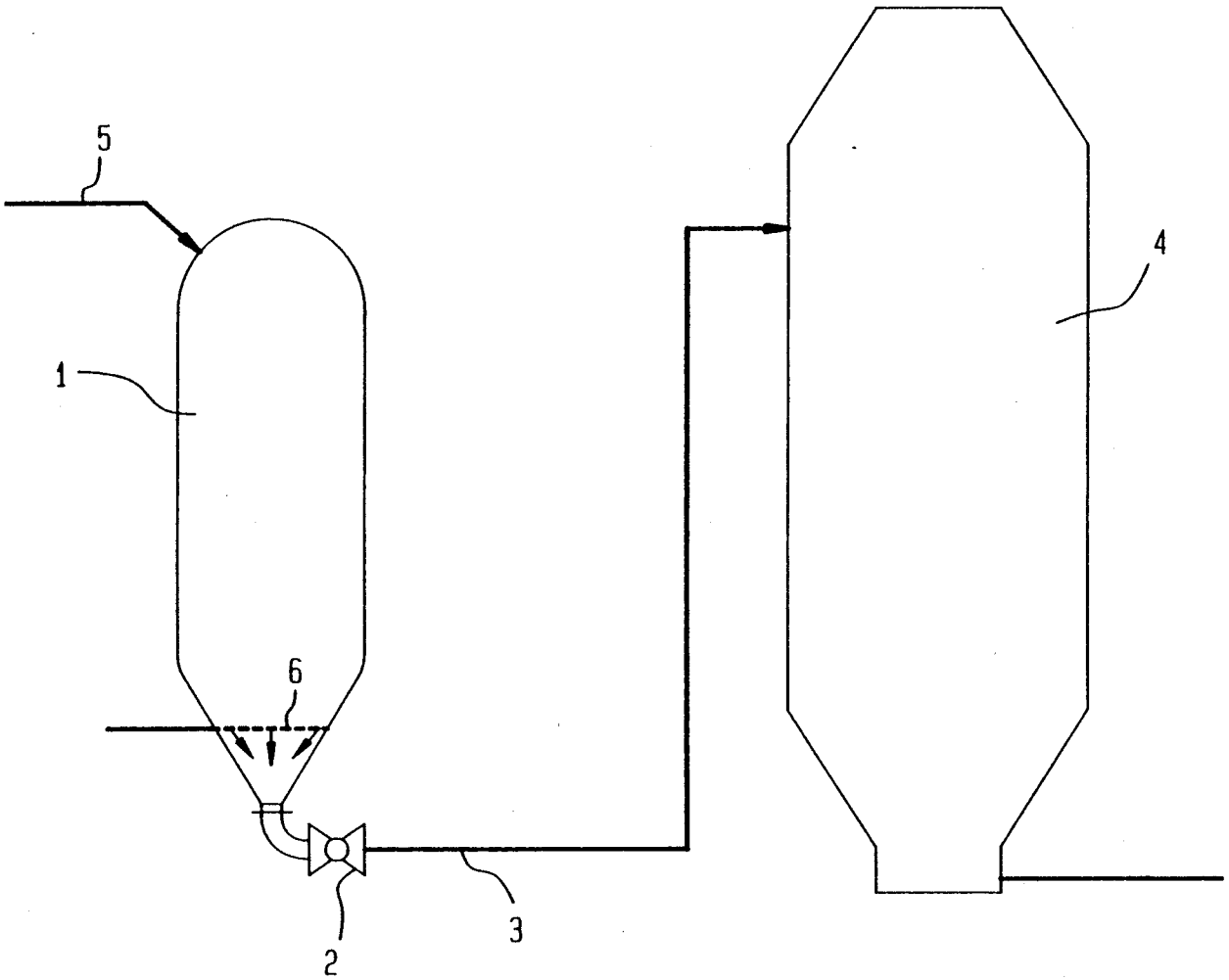
FIG. 1 is a schematic representation of one embodiment of a system for carrying out the method of the present invention.

Referring to the Figures, in which like numerals refer to like portions thereof, FIG. 1 shows a digester 1 and a receiving vessel 4 connected by a valve 2 in conduit 3. After termination of a sulfate cook in digester 1, the cooked lignocellulose material is cooled to a temperature of about 100° C.. Preferably, cooling is carried out to a temperature above 100° C., and preferentially between about 100° and 120° C. The cooling process is normally performed by displacing the hot spent cooking liquor in the digester by a cooler liquor. Maintenance of a temperature just above about 100° C. after the cooling process guarantees the presence of a limited overpressure in the digester. Of course, instead of a sulfate cook, other types of cooks can be performed as well.

After the cooling step, valve 2 in conduit 3 is opened in order to create a connection between the bottom of the digester 1 and a receiving vessel 4, where preferably atmospheric pressure prevails. This receiving vessel 4 is normally arranged so that the conduit 3 connects the bottom of the digester 1 with a point at a higher level in the receiving vessel 4.

Discharge from the digester is performed by the utilization of a push-out pressure which is maintained by the supply of a gas, such as air or steam, through a gas inlet 5 in the upper portion of the digester 1. Thus, the push-out pressure is actually the combination of that gas pressure and a static pressure, the static pressure being determined by the level of cooked lignocellulose within the digester. According to this invention, this push-out pressure shall not be substantially higher than the minimum pressure which is required in order to overcome the flow resistance and the level difference in transfer of the lignocellulose material from the digester 1 to the receiving vessel 4. This level difference represents the lifting height between the outlet of the digester 1 and the inlet of the receiving vessel 4. This push-out pressure shall preferably be, at maximum, 200 kPa higher than the minimum required pressure, and preferably at maximum 100 kPa higher. This is considerably lower than the pressure in conventional cold blow systems, where the supplied gas pressure can generally be between about 500 and 700 kPa.

In order to render possible a uniform and controlled discharge, a supply of dilution liquid is also required in the lower portion of digester 1. This is preferably carried out by means of dilution nozzles 6, which can be located in the bottom of the digester, or a small distance higher up therein. The reason for this dilution is to prevent channelling, to reduce the material consistency, and to thereby reduce frictional resistance, and to prevent gas breakthrough. Furthermore, cooling of the lignocellulose material is obtained during discharge so that the temperature in the material being transferred to the receiving vessel will be below about 100° C. In this manner, a discharge method is obtained which substantially avoids flashing, and reduces pressure variations in the receiving vessel, thus simplifying the treatment of both evil-smelling gases and condensate. As will be immediately apparent to those of ordinary skill in this art, the transfer temperature can be somewhat higher, provided that the pressure is such that flashing can still be avoided.

Figure 2:
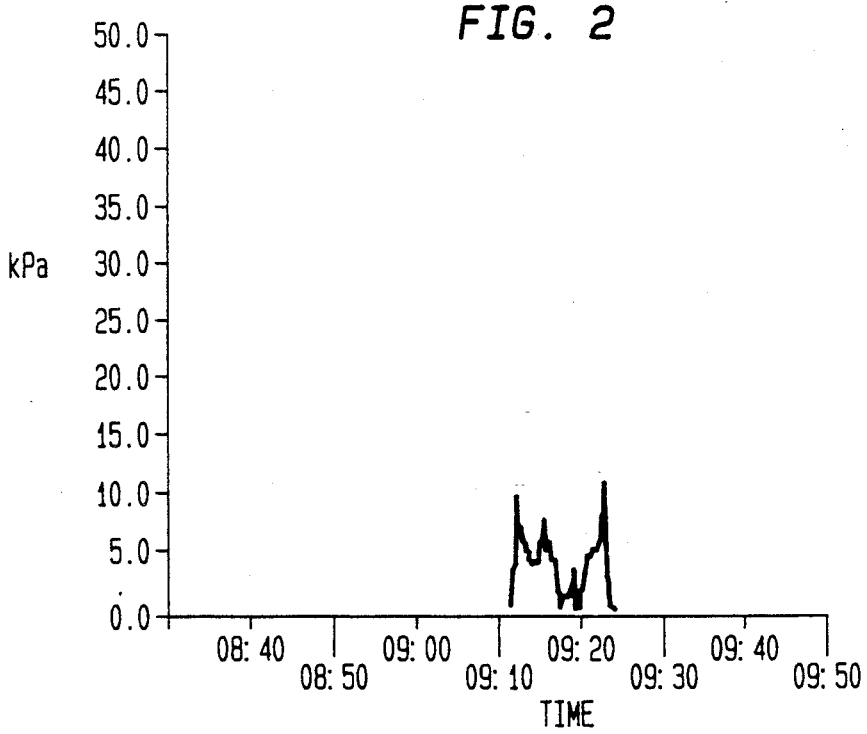
FIG. 2 shows a graphical representation showing pressure variations in a receiving vessel and digester in accordance with the method of the present invention.
Figure 3:
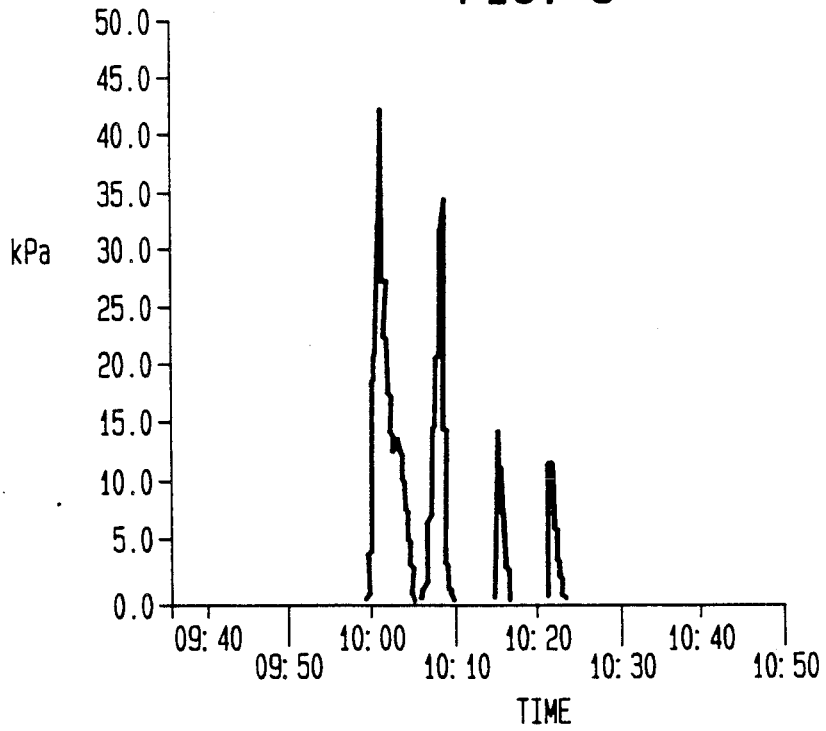
FIG. 3 shows a graphical representation of pressure variations in a receiving vessel in connection with a digester used in accordance with the so-called "cold blow" process of the prior art.

FIGS. 2 and 3 show the pressure variations in the receiving vessel 4 following the digester 1 during discharge, as measured in a full-scale test. FIG. 2 shows the pressure variations when the method of the present invention was used, and FIG. 3 shows the pressure variations when the so-called "cold blow" discharge method was used, as discussed in the background portion of this specification. These Figures show that the present invention produces significantly lower pressure peaks in the receiving vessel, in particular, 5 to 15 kPa as compared to 40 to 50 kPa with conventional cold blow. Moreover, repeated blows are not necessary according to the present method. In this manner, the total discharge time was shorter, e.g., from 15 to 17 minutes, as compared to 20 to 30 minutes for the cold blow process, which makes it possible to increase production.

The consistency of the lignocellulose material during transfer is preferably between about 3 and 10%, and preferably between about 5 and 10%.

In order to obtain uniform discharge, the push-out pressure should be maintained substantially constant during the discharge procedure, and therefore the supplied gas pressure should be increased as the static pressure is reduced.

Furthermore, the method according to the present invention also provides an indulgent treatment of cellulose fibers which results in increased strength properties for the product thereof.

Because of its simplicity, the present method can be utilized in existing batch digesters without substantial reconstruction of the digesters and their transfer conduits. No new equipment is thus required which would complicate the layout and availability of same in a digester. Furthermore, the service costs will be low, and the production accessibility will be high. Moreover, it should be noted that existing digester outlets and transfer conduits can be maintained. it will thus still be possible to perform conventional warm or cold blow without the need to switch equipment or conduits therein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for the discharge of cooked lignocellulose material from a digester containing said cooked lignocellulose material in an amount providing a predetermined static pressure to a receiving vessel, said digester having an upper portion and a lower portion, and including an exit port at said lower portion at a predetermined level therein, and said receiving vessel having an entrance port at a predetermined level therein, said predetermined level in said receiving vessel being higher than said predetermined level in said digester by a predetermined level difference, and said exit port of said digester and said entrance port of said receiving vessel being connectable through a conduit providing a predetermined flow resistance between said digester and said receiving vessel, said method comprising cooling said cooked lignocellulose material in said digester to a temperature in the range of about 100° C. to 120° C., supplying a gas to said upper portion of said digester so as to provide a predetermined gas pressure therein, wherein the combination of said predetermined gas pressure and said predetermined static pressure exceeds the sum of the pressure required to overcome said predetermined level difference and said predetermined flow resistance in order to transfer said cooked lignocellulose material from said digester to said receiving vessel by no greater than about 200 kPa, and connecting said exit port in said digester with said entrance port in said receiving vessel so as to transfer said cooked lignocellulose material through said conduit.

2. The method of claim 1 including supplying a dilution liquid to said lower portion of said digester.

3. The method of claim 1 wherein said supplying of said gas to said upper portion of said digester comprises increasing said supply of gas during said transfer of said lignocellulose material from said digester to said receiving vessel so as to maintain said combination of said predetermined gas pressure and said predetrmined static pressure during said transfer at a substantially constant level as said static pressure is reduced in said digester.

4. The method of claim 1 wherein said combination of said predetermined gas pressure and said predetermined static pressure exceeds said sum of said pressure required to overcome said predetermined level difference and said predetermined flow resistance by no greater than about 100 kPa.

5. The method of claim 1 wherein said lignocellulose material exits from said digester at a consistency of between about 3 and 10%.

6. The method of claim 5 wherein said lignocellulose material exits from said digester at a consistency of between about 5 and 10%.

* * * * *